US007334340B2

(12) United States Patent
Eldar

(10) Patent No.: US 7,334,340 B2
(45) Date of Patent: Feb. 26, 2008

(54) PUNCH TOOL FOR LAYFLAT HOSE

(76) Inventor: Mordechai Eldar, Odem 12, Neve Savyon, Or Yehuda (IL) 60406

( * ) Notice: Subject to any disclaimer, the term of this patent is extended or adjusted under 35 U.S.C. 154(b) by 0 days.

(21) Appl. No.: 11/137,815

(22) Filed: May 24, 2005

(65) Prior Publication Data

US 2005/0274027 A1 Dec. 15, 2005

(30) Foreign Application Priority Data

Jun. 13, 2004 (IL) ..... 162538

(51) Int. Cl.
*B26F 1/02* (2006.01)

(52) U.S. Cl. ..... 30/363; 30/358

(58) Field of Classification Search ..... 30/358, 30/359, 360, 361, 363, 278, 280
See application file for complete search history.

(56) References Cited

U.S. PATENT DOCUMENTS 788,295 A * 4/1905 Weixler ..... 30/363
835,740 A * 11/1906 Walden ..... 30/363
938,580 A * 11/1909 Harling ..... 30/363
2,359,699 A * 10/1944 Valentine ..... 30/358
3,335,494 A * 8/1967 Klenk ..... 30/363
6,189,220 B1 * 2/2001 Chen ..... 30/358
6,751,874 B2 * 6/2004 Eldar ..... 30/363

* cited by examiner

*Primary Examiner*—Hwei-Siu C. Payer
(74) *Attorney, Agent, or Firm*—Ostrolenk, Faber, Gerb & Soffen, LLP

(57) ABSTRACT

A cutting tool for forming a hole in the wall of a plastic pipe has a body portion defined by a rear grasp portion and by a frontal portion. The frontal portion is provided at one end with a through going vertical passage which accommodates the cutting element therein and guides the cutting element. A frontal portion of the body has a mounting pin and the body has an upper compartment with a spring. A pressure handle enables pivotal displacement thereof between an erected position and a depressed position which enables forceable displacement of the cutting element from an uppermost position to a lowermost position and vice versa.

3 Claims, 6 Drawing Sheets

PUNCH TOOL FOR LAYFLAT HOSE

BACKGROUND OF THE INVENTION

In irrigation of agricultural fields, one of the types of piping, that is relatively new, and becoming popular, is the layflat hose. Its primary advantage is its flexibility, similar to fire-hose, but made out of composite plastic material containing reinforcing fibers. When there is no water flowing through the hose, the hose is flat, but when water flows the hose blows up and becomes round. This type of piping is the main pipeline onto which smaller pipes are attached to bring the water to the plants. The wall thickness of this hose is between 1 mm and 2.5 mm. In comparison to the regular irrigation piping made of polyethylene, the hole making in the layflat hose is problematic because of the flexibility of the hose. Conventional tools, including a tool which is disclosed in Israeli design patent no: 27236, are not efficient for punching layflat hoses, since a great amount of effort is needed in order to perforate the layflat hose. The present invention is directed to a new tool. The new tool is defined by a cutting member with special cutting geometry of the cutting edges that ensure an easy cut in this layflat hose. The new tool is also provided with a mechanical connection between the handle and the pushing element, and by virtue of this provision the blade can be extricated from the hose in case of catching in dirt or in the fibers of the hose during the holing process when, in this case, the spring coil does not have sufficient strength to return the cutting member to its resting position.

DETAILED DESCRIPTION OF THE INVENTION

Figure 3:
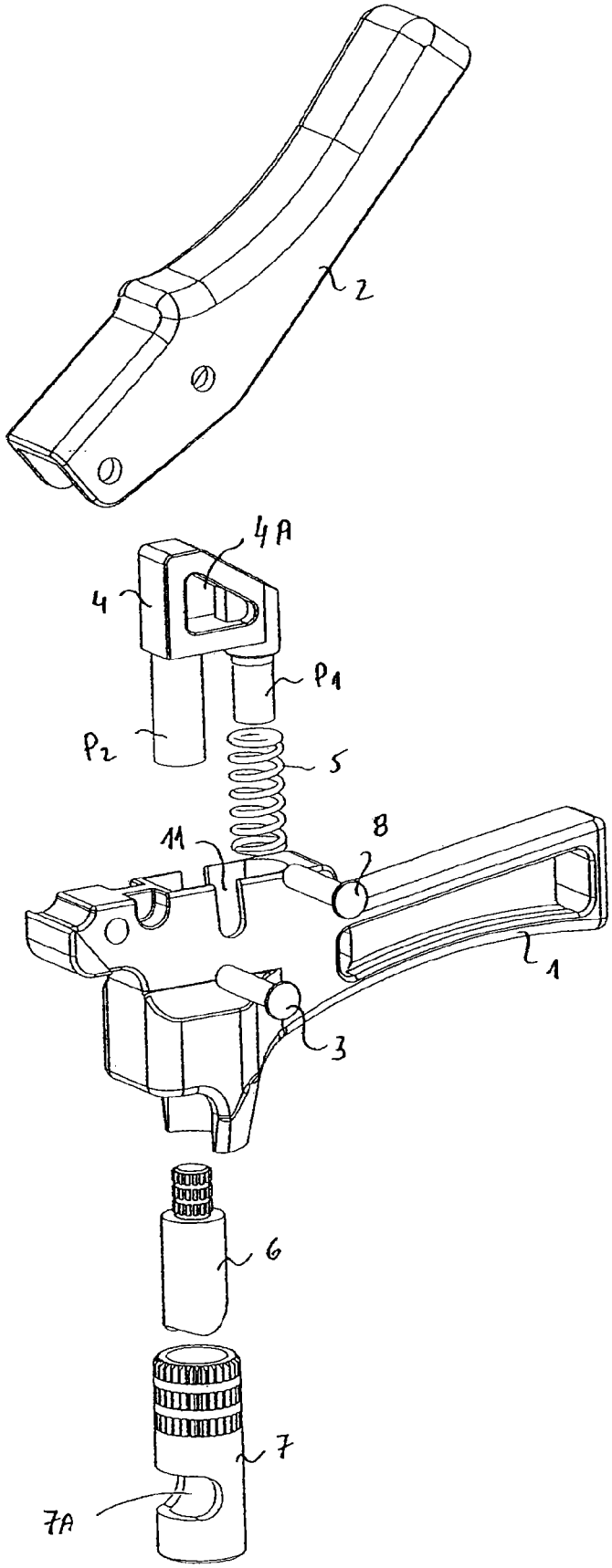
FIG. 3: is an exploded view of the tool of the invention.

With reference to FIGS. 2,3 it will be explained now the construction of the punching tool of the present invention. The punching tool of the invention comprises the following main elements:

The body (1) of the tool.

The handle (2) of the tool.

Holding pin (3) which pivotally connects the body with the handle.

Pushing element (4) provided with a through going window (4*a*).

Spring coil (5).

Guiding member (7) fitted with cutting element (6).

Access window (7*a*) of the guiding member (7).

Pin (8) that provides connection between the pushing element (4) and the handle (2).

All the parts of the tool are made of hard plastic material, apart from the spring coil made of steel, and the blade and cylindrical guiding portion made of hardened and sharpened steel.

Below is a short summary of how the tool operates:

To a body (1) of the tool is pivotally attached a handle (2) by means of a holding pin (3). When the handle (2) is pushed in the direction of the body (1) of the tool, a lever action is precipitated that pushes down on the pushing element (4) that pushes a cutting element (6) in a downward motion to cut a layflat hose (9) that is received within the access window (7*a*) provided in the guiding member (7). The guiding member is situated within the lower part of the body (1) of the tool. The access window (7*a*) of the guiding member (7) receives the hose (9) therein to expose it to the punching action performed by the cutting element (6), when it displaces along the guiding member (7). It is not explained in details, but should be appreciated that the cutting element (6) has its outside diameter fitting to the inside diameter of the guiding member (7) to enable guiding. The cutting element (6) is secured within the pushing element (4). The pushing element (4) that is shaped as an upside down U, sits appropriately inside frontal portion of the tool body (1) and has freedom of linear reciprocative movement. The right side of the pushing element (4) is provided with a protrusion P1 along which extends the spring coil (5) that forcibly returns the pushing element (4) to its resting position at the end of the cutting action. The pushing element is also provided with a second protrusion P2, which extends parallel to the protrusion P1. This protrusion is intended for connecting with the cutting element. On the underside of the handle (2) there are two protrusions (10) that ensure that the pushing element (4) retains its correct position within the handle (2). During the cutting action, the pin (8) that passes through a window (4*a*) made in the pushing element (4) is free to move downward along the hollow (11) provided in the upper part of the body of the tool. In the event that the cutting element (6) is caught in the fibers of the hose (9) it is possible to release the cutting element (6) and forcibly return it back up to its resting position by pulling the handle (2), which displaces the pushing element (4) up by virtue of the pin (8). The waste plastic (12) falls out of the tool and out of the hose (9). The possibility to return the blocked cutting element (6) is one of the novelties of the punching tool of the present invention. The other novelty of the tool lies in the special geometry of the cutting element.

With reference to FIGS. 1, 4, 5, and 6, the geometry of the new cutting element (6) employed in the cutter tool of the present invention. The cutting element (6) is provided with a body portion (22) fitted with a neck portion (24) for accommodating within appropriate bore provided in the second protrusion P2 of the pushing element. The cutting element (6) is provided with new cutting geometry which enables the holing of layflat hose (9) as described in FIG. 1. It can be seen that the folded layflat hose (9) is positioned in the access window (7*a*) of the guiding member (7), and when pressure is exerted on the handle (2), the cutting element (6) moves downwards along the guiding member (7), penetrating into the hose (9) and thereby creating holes (14, 16, 18) in the hose (9). The special geometry of cutting edges of the cutting element (6), according to the present invention, that shall be described forthwith, ascertains the holing of the layflat hose (9) is effected in the most efficient and effortless way possible. The cutting element (15), as is known in the art, is depicted in FIG. 4. This cutting element has cutting edges (17) which are arched with their center laying on the longitudinal axis (o-o) of the cutting element. The new cutting element (6) as described in FIG. 4: *c, d, e*, and FIG. 5 has such geometry that its cutting edges are not symmetrical in relation to the longitudinal axis (x-x) of the cutting element (6). Now with reference to FIG. 5: *a, b*, it will be explained how this geometry is obtained. The new cutting element (6) is manufactured from blank that is either a hollow tube or a solid rod by virtue of the milling action. The milling action is effected in such a manner, that the rotational axis (y-y) of the milling cutter (20) crosses with the axis (x-x) but does not pass through it. The milling process is executed by a milling cutter (20) which has an outer diameter D equal to, or less than, the outer diameter d of the blank for the cutting element (6). It can be seen in FIG. 5A, that the axis (y-y) of the milling cutter (20) and axis (x-x) of the blank, are linearly displaced so that a distance ($\Delta$) is created between them. In practice this distance is approximately 1 mm. In FIG. 5*b* it can also be seen that the rotational axis (y-y) of the milling cutter (20) is angularly displaced with respect to longitudinal axis (x-x) of the blank by an angle ($\alpha$) In practice this angle is up to 110 degrees. Thus the arched cutting edges are created, which are a-symmetrical in relation to axis (x-x). In FIG. 5: *c, d*, and FIG. 6*c* it can be seen that the working end of the cutting element (6) featuring its arched back edge (26) and its arched front cutting edge (28), its arched lower cutting edge (30) and its arched upper cutting edge (32). It can also be seen that the cutting edge (30) is situated lower than cutting edge (32) so that during the cutting action the cutting edge (30) first meets with the hose material (9) and penetrates it, and only after this, the upper cutting edge (32) also meets with the hose material (9). This cutting action is described in FIG. 4*c, d, e*.

Figure 1A:
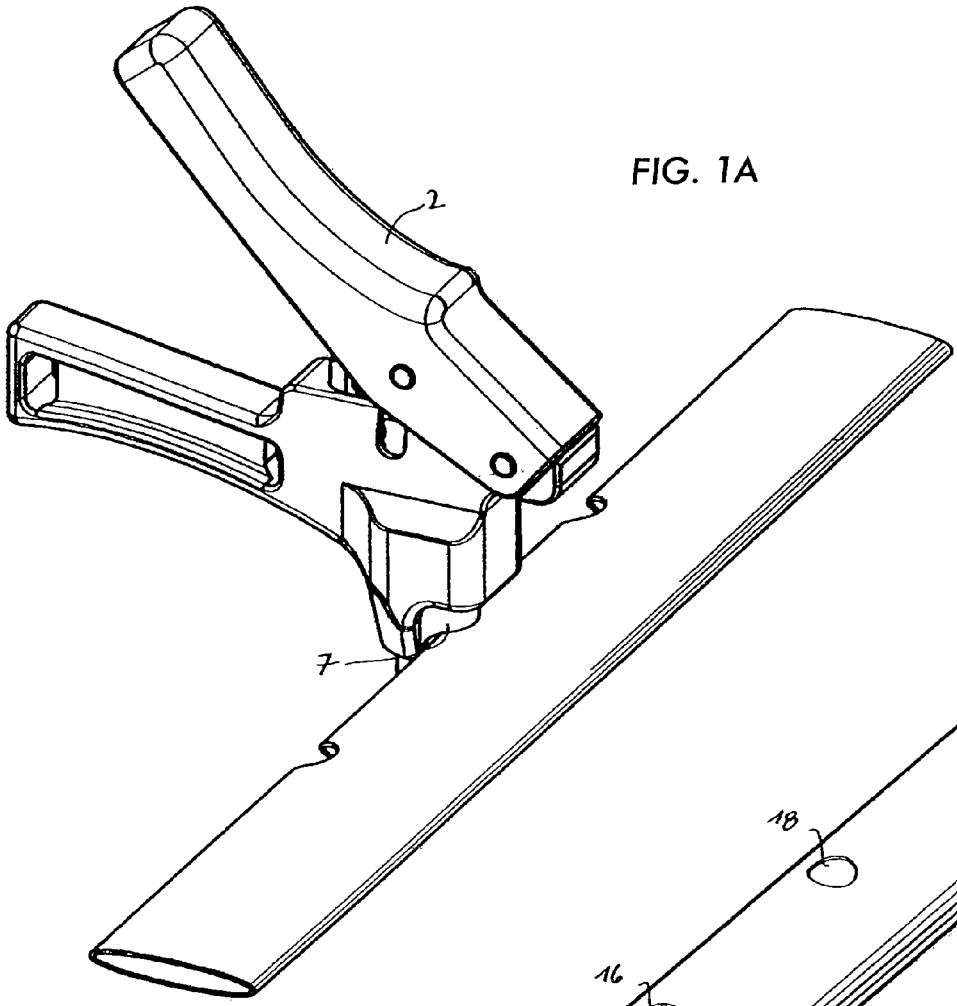
FIG. 1*a*: is an isometric presentation of the tool of the present invention during punching of the layflat hose.
Figure 1B:
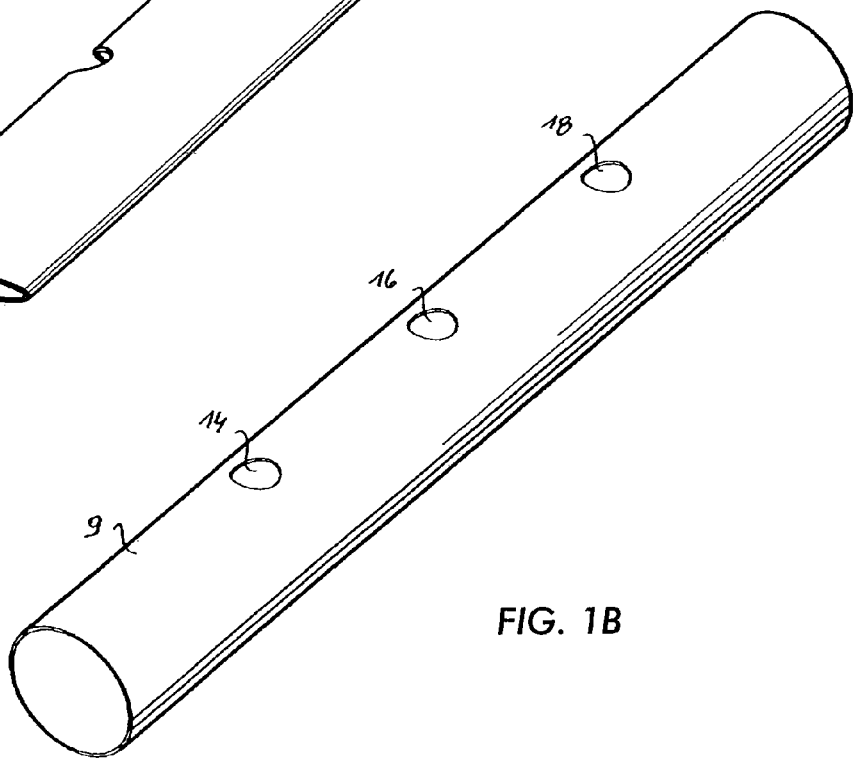
FIG. 1*b*: presents layflat hose with punched holes.
Figure 2B:
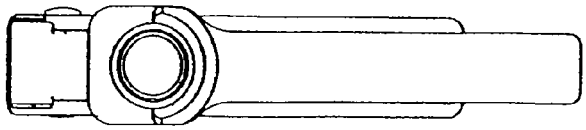
FIG. 2*b*: is a bottom view of the tool of the invention.
Figure 2D:
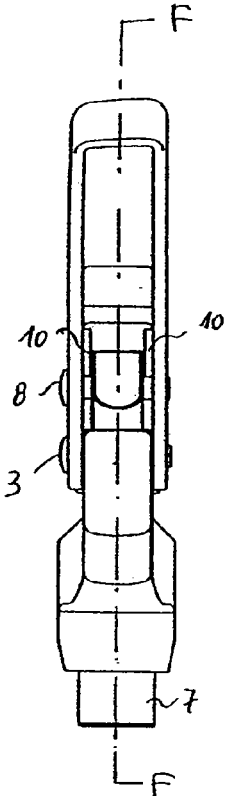
FIG. 2*d*: is a left side view of the tool of the invention.
Figure 2A:
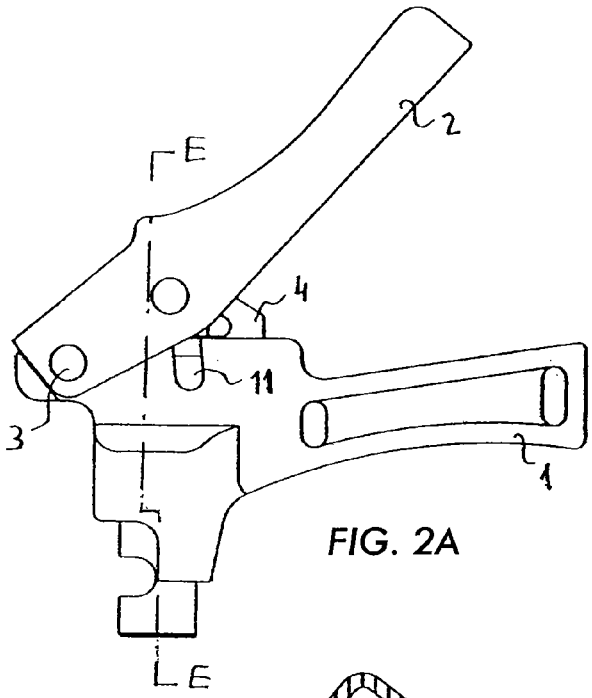
FIG. 2*a*: is a front view of the tool of the invention.
Figure 2E:
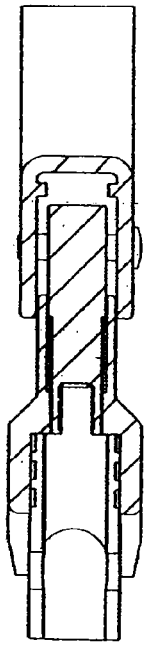
FIG. 2*e*: is a cross-sectional view of the tool presented in FIG. 2*a* along direction E-E.
Figure 2F:
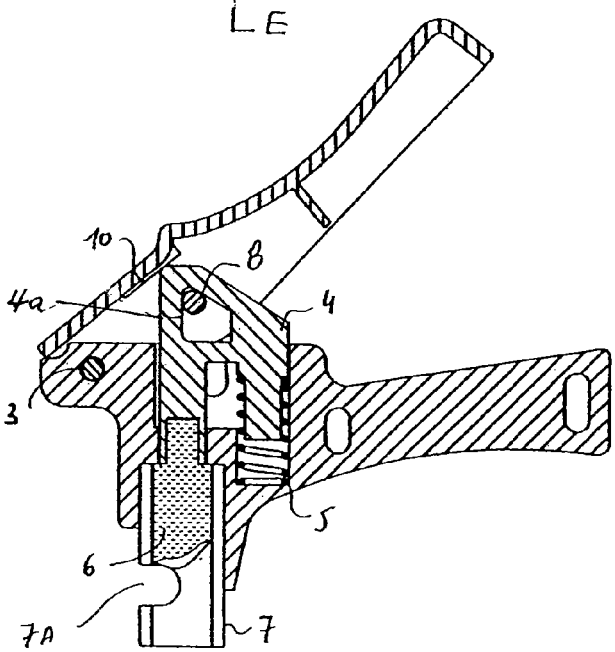
FIG. 2*f*: is a cross-sectional view of the tool presented in FIG. 2*d* along direction F-F.
Figure 2C:
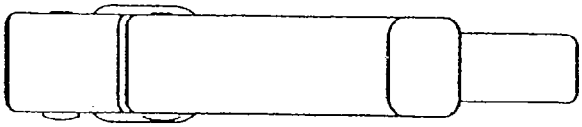
FIG. 2*c*: is an upper view of the tool of the invention.
Figure 4C:
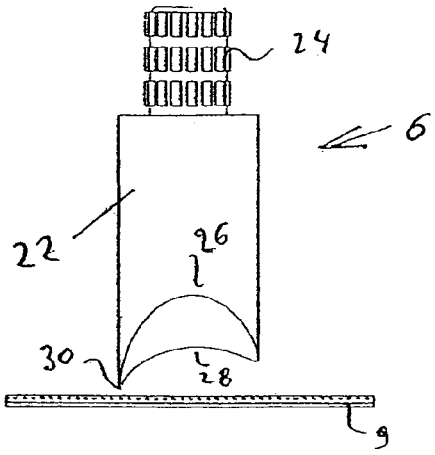
FIGS. 4*c-e*: show schematically how layflat hose is being cut.
Figure 4D:
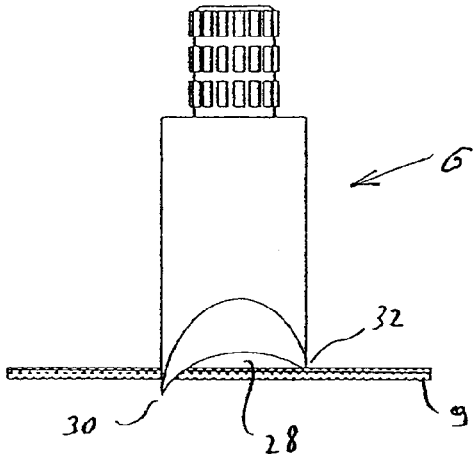
Figure 4E:
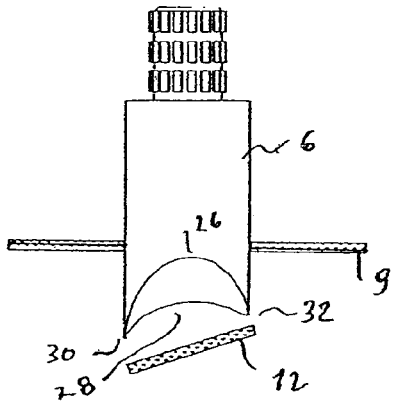
Figure 4A:
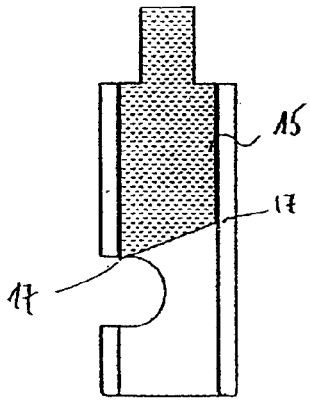
FIG. 4A PRIOR ART
FIGS. 4*a,b*: are cross-sectional views of a tubular cutter known in the art.
Figure 4B:
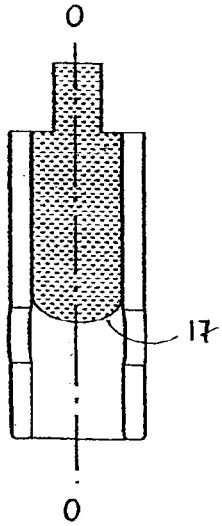
FIG. 4B PRIOR ART
Figure 5C:
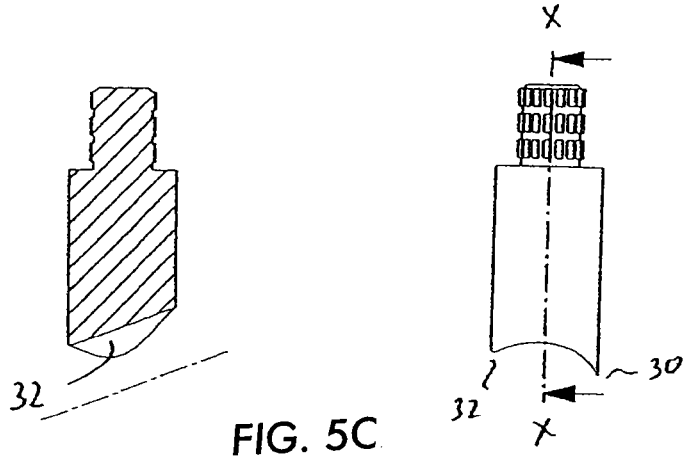
FIGS. 5*c,d*: are side views and cross-sections of the cutting element of the invention.
Figure 5D:
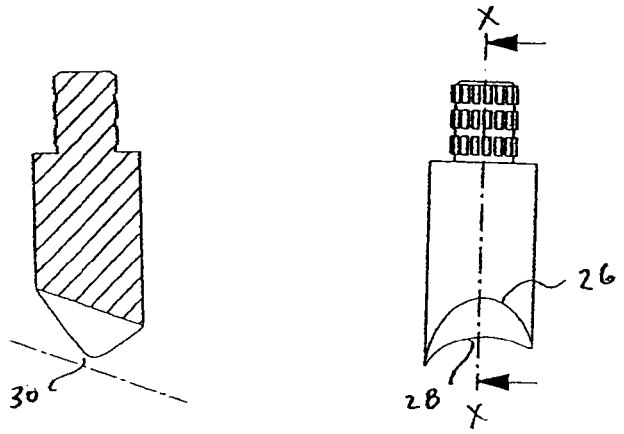
FIGS. 5*a,b*: show schematically how cutting element employed in the tool of the invention is manufactured.
Figure 5A:
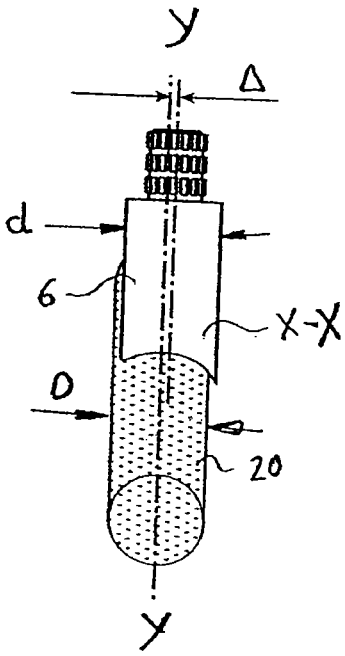
Figure 5B:
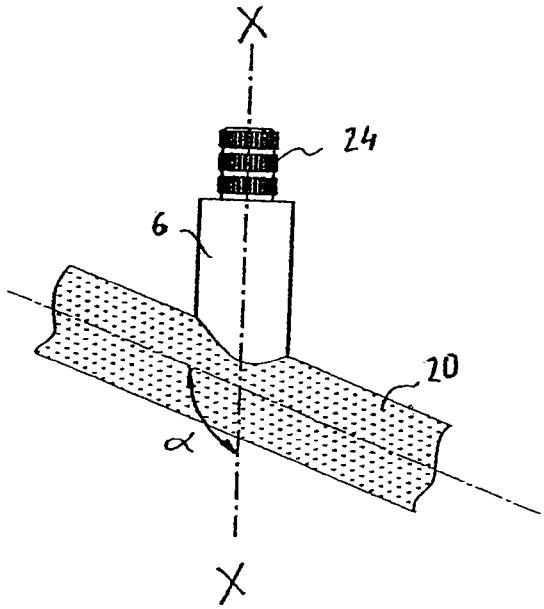
Figure 6A:
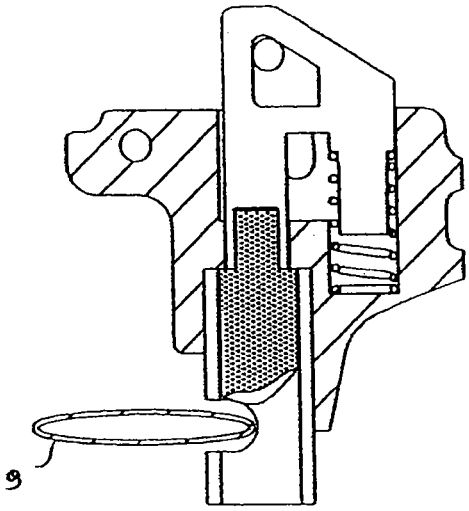
FIGS. 6*a,b*: show how cutting element of the invention punches layflat hose.
Figure 6B:
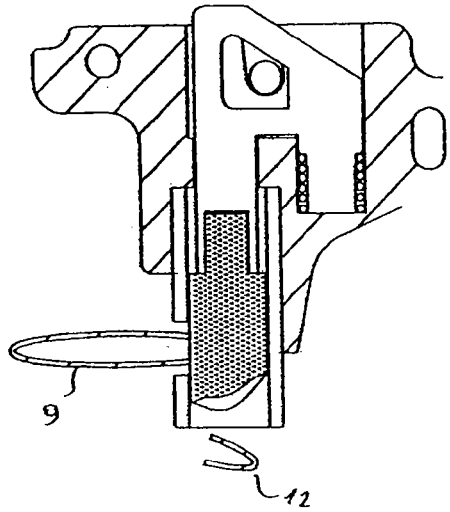
FIG. 6*c*: is an isometric view of the cutting element of the invention.
Figure 6C:
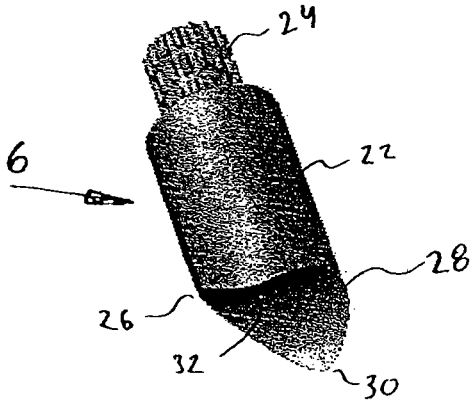

In FIG. 4*c* the cutting edge (30) of the cutting element (6) is seen to almost reach the hose (9) and is ready to penetrate it. In FIG. 4*d*, the lower cutting edge (30) is seen already penetrated through the hose (9) and the upper cutting edge (32) approaching and ready to penetrate it. In FIG. 4*e*, the whole cutting element (6) can be seen to have penetrated the hose (9), the upper and lower cutting edges (30 =32) penetrated through the hose (9) and waste plastic (12) has been created. After the extraction of the waste plastic (12), which is a half-circle shape, due to the fact that the hose (9) is folded, the circular hole is created in the hose (9). The hose with circular holes 14,16,18 is seen in FIG. 1*b*. At the completion of the holing process, the cutting element (6) is released from the hose (9) by virtue of the spring coil (5) pulling the element (4) and the cutting element (6) up. It should be noted that the cutting action is executed easily by virtue of the fact that the cutting edges do not simultaneously penetrate the hose (9), thus the pressure exerted on one cutting edge is greater than the pressure which would be applied on two cutting edges simultaneously. It should be appreciated that features disclosed in the foregoing description, and/or in the foregoing drawings, and/or examples, and/or following claims both separately and in any combination thereof, be material for realizing the present invention in diverse forms thereof.

The invention claimed is:

1. A cutting tool for forming a hole in a wall of a plastic lay flat pipe by virtue of a cutting element, capable to penetrate through the wall upon applying a force thereon, the tool comprising:

a body portion defined by a rear grasp portion and by a frontal portion, said frontal portion is provided at its lower extremity with a through going vertical passage, said passage is adapted for accommodating the cutting element therein and for guiding the cutting element there-along from an uppermost position to a lowermost position; the frontal portion of the body portion is provided with a mounting pin, said body portion is provided with an upper compartment for deployment therein a pushing member and a spring means; and a pressure handle connected by the mounting pin to the body portion so as to enable pivotal displacement of the pressure handle between an erected position and a depressed position, wherein said pivotal displacement of the pressure handle entails forcible displacement of the cutting element from the uppermost position to the lowermost position or vice versa, wherein said pushing member is connected to the pressure handle and to the cutting element such that the pushing member pushes the cutting element down when the pressure handle is displaced from the erected position to the depressed position or forcibly pulls the cutting element up when the pressure handle is displaced from the depressed position to the erected position, and said pressure handle is provided with an auxiliary mounting pin and said pushing member is provided with a window, wherein said auxiliary pin passed through said window to ensure that the pushing member is forcibly pulled up by the pressure handle when the pressure handle displaces from the depressed position to the erected position.

2. The cutting tool as defined in claim 1, in which said cutting element is detachably connected to the pushing member.

3. The cutting tool as defined in claim 1, in which said vertical passage is provided with an access window for receiving the pipe there-into.

* * * * *